United States Patent [19]

Regnault et al.

[11] Patent Number: 4,743,922

[45] Date of Patent: May 10, 1988

[54] INK JET SINGLE-NOZZLE PRINTING HEAD

[75] Inventors: Luc Regnault; Jean-Louis Reynaud, both of Bourg Lès Valence, France

[73] Assignee: Imaje S.A., Bourglès Valence, France

[21] Appl. No.: 893,298

[22] PCT Filed: Nov. 7, 1985

[86] PCT No.: PCT/FR85/00317

§ 371 Date: Jul. 11, 1986

§ 102(e) Date: Jul. 11, 1986

[87] PCT Pub. No.: WO86/02885

PCT Pub. Date: May 22, 1986

[30] Foreign Application Priority Data

Nov. 13, 1984 [FR] France ..... 84 17404

[51] Int. Cl.[4] ..... G04D 15/18

[52] U.S. Cl. ..... 346/75

[58] Field of Search ..... 346/75

[56] References Cited

U.S. PATENT DOCUMENTS 4,356,499 10/1982 Kodama ..... 346/75

4,417,256 11/1983 Fillmore et al. ..... 346/75

4,520,367 5/1985 Ishikawa et al. ..... 346/75

*Primary Examiner*—Clifford C. Shaw

*Assistant Examiner*—Gerald E. Preston

*Attorney, Agent, or Firm*—Roland Plottel

[57] ABSTRACT

In a ink jet printing head, all essential elements are made integral with a monolithic part (2) acting as a base. Furthermore, the modulation body (10) cooperates with adjusting means (screw 84 and oblong holes 85) according to two angles ($\alpha$) and ($\beta$), situated in two perpendicular planes. The charge (71), charge-control (72) and deflexion (73, 74) electrodes are integral with a block (70). The electric isolation is provided particularly by means of a groove (89) and a web (90), thereby preventing any arc formation. The inventon can be applied to any ink jet printer.

8 Claims, 3 Drawing Sheets

INK JET SINGLE-NOZZLE PRINTING HEAD

The invention relates to a single nozzle ink jet printing head.

The ink jet printing technique includes forming a continuous jet of calibrated drops, supplied by a modulation system then in electrostatically charging these drops by means of charge electrodes, so as to deflect each drop by means of an electric field so that if the support on which it is desired to write and the writing device are moving relatively to each other, the formation of a printing matrix is obtained.

In an ink jet printer, the above mentioned function, namely the fragmentation of the jet into calibrated drops, the electrostatic charge thereof and deflection thereof are obtained by means of a device called printing head in the rest of the description.

The role of this head is fundamental for the correct operation of an ink jet printer. In particular the path of the drops ejected at the level of the injection nozzle must be perfectly defined with respect to the charge electrodes the deflection plates and the support which receives the impression. The printing head complying with these criteria must in addition be compact, require no adjustment during operation and allow simple and reliable adjustments to be made previous to starting up. Finally, this head must have a great facility of access for maintenance purposes.

A printing head corresponding to these criteria has been described in a French patent application 82 03975 filed on the 7th Mar. 1983 by the applicant. In this printing head, the means for breaking the jet and ejecting the drops are fixed to the body of the cap and the charging and deflecting means are fixed to the lid of said cap.

In the present application, on the other hand, all these essential elements of the printing head are fixed to one and the same monolithic piece, this architecture contributing to reducing the space required by the assembly without adversely affecting the adjustment facilities, nor the isolating conditions, particularly of the deflection electrodes.

Another object of the invention is to described a support block for the integrated charge control electrodes and deflection plates.

Another object relates to a safety device limiting the current in the circuit feeding the deflection means.

The invention also relates more precisely to a single nozzle ink jet printing head of the type having an ink supply circuit, a signal amplifier, an ink recovery detector, means for breaking the jet and ejecting the drops, means for charging and deflecting the drops; characterized in that the whole of these means is fixed to a monolithic piece serving, on the one hand, as base for the means and, on the other hand, as case for cooperating with a lid for forming the covering cap of the head.

The invention will be better understood from the following explanations and accompanying Figures in which.

For the sake of clarity, the same elements bear the same references in all the Figures.

Figure 1:
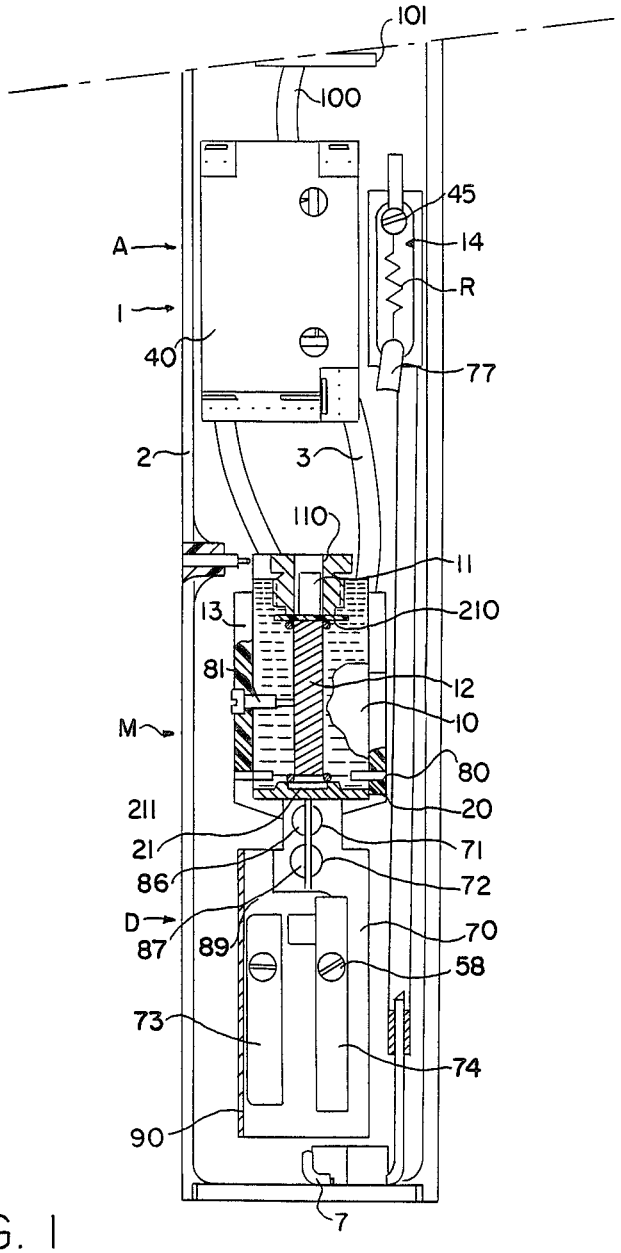
FIG. 1 illustrates an important part of a printing head including the essential functional elements such as the drop formation and injection means, the means for charging the drops and the deflection means.
Figure 3:
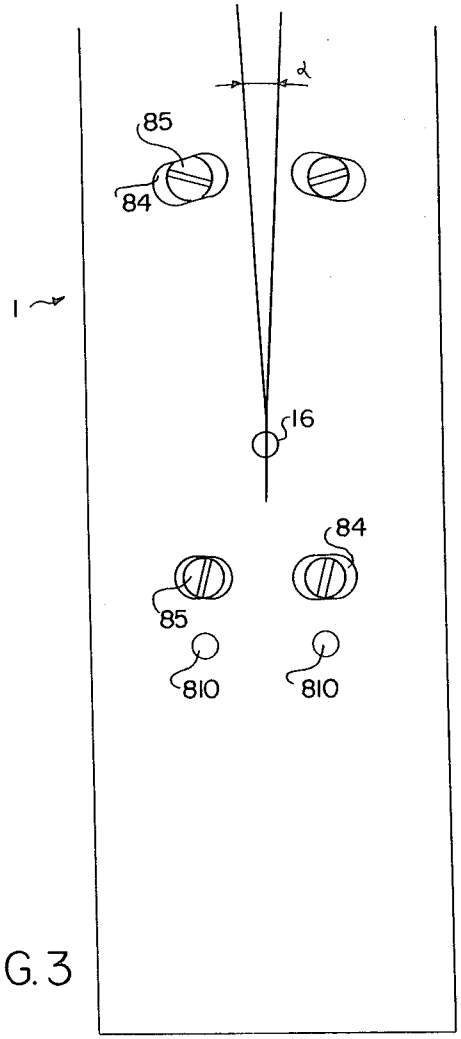
FIGS. 2 and 3 illustrate schematically the main elements described with reference to FIG. 1.
Figure 2:
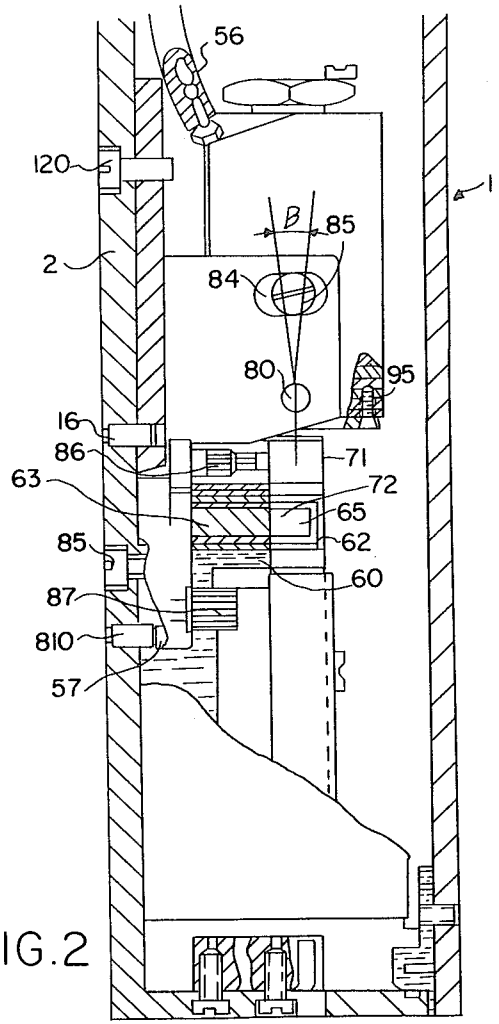

As shown in FIG. 1, completed by FIGS. 2 and 3 to which the rest of the description simultaneously refers, a printing head 1 according to the invention is formed of a monolithic piece 2. This piece 2 fulfills two functions: on the one hand it plays the role of cap body, and on the other it serves as base for all the means providing the essential functions of the head: namely, particularly the means for forming and ejecting the drops, charging them and deflecting them. A lid closes the case but it has no other function, contrary to what happens in the case of the printing head described in the above mentioned patent, no other function than that of closing the case, while allowing the combination of the above mentioned means to be examined when it is open.

These latter means are all shown in FIG. 1, where only the complementary environment is missing which is not directly in relation with the invention. In the top part (A) we find the inlet of the ink supply circuit 100 fixed to head 1 by means of a connecting nut 101 partially shown). We also find the signal amplifier 40. This latter may be enclosed in a cavity (not shown) provided for this purpose in case 2.

Finally, a detector 14 for the recovery of ink recovered at the level of gutter 7 via duct 77 is also housed therein. This detector 14 is fixed to the monolithic piece 2 by fixing means 45 and comprises integrally a resistance R which fulfills a current limiting function as will be explained further on.

The central part M also includes the modulation means causing break up of the jet and the means for ejecting the drops thus created.

The modulation body 10 is carried by a support 13, made from an insulating material which is fixed to the monolithic piece 2 by a set of screws 120. Inside this modulation body is introduced the combination of the piezoelectric transducer 11 associated with its resonator 12 at the end of which is placed the plate 20 supporting the nozzle 21. This plate 20 is fixed to support 13 for example by means of a screw 95 mounted perpendicularily.

An O seal 210 is provided at the top end of resonator 12. In combination with a packing 110 it provides sealing at this level. A second O seal 211 is also provided at the low part of the modulation body and it provides sealing between this body 10 and the plate 20 holding nozzle 21. The modulation body 10 of the invention may be oriented in two perpendicular planes through two angles ($\alpha$) and ($\beta$). In fact, it may rotate about a first positioning and centering pin 80 giving it the degree of freedom through ($\beta$) and about a second pin (16) giving it the degree of freedom through ($\alpha$).

When the correct positioning of the modulation body and so of the jet is obtained, screws 85 cooperating with oblong holes 84 lock body 10 in the two planes.

Connections 56 connect the ink circuit to the modulation body.

The low part D concerns the combination of the charging electrodes and the members deflecting the ink drops. More precisely and according to another important characteristic of the invention, it is a sub assembly also monolithic formed of a support block 70 on which are mounted the charge 71 and charge control 72 electrode as well as the left 73 and right 74 deflection plates.

According to another important characteristic of the invention, this electrode support block 70 is made from an isulating material whose dielectric characteristics and thicknesses ensure, between the monolithic base 2 and said electrodes, an insulating level compatible with the voltages used at this level. In addition, so as to avoid arc formation, an insulating groove 89 as well as a web 90 providing a veritable insulating wall is provided on the side of the deflection electrode brought to a very high voltage.

The charge control electrode 72 is for example of the type described in the patent application No. 83 07549 filed on the 29th Apr. 1983 by the applicant. In this case it is formed of a cylindrical assembly 60 made from a conducting material having a bore in which is introduced a second tube 62 made from an insulating material. This latter is introduced into cylinder 60 so that its external surface is in perfect contact with the internal surface of cylinder 60 over a given length less than that of cylinder 60. This second tube 62 forms a sleeve inside which is introduced a solid cylinder 63 made from a conducting material. In this assembly a slit 65 is formed through which the ink drops transit, shown with broken lines. According to a characteristic of the present invention, two light emitting diodes 86 and 87 are positioned respectively, the first one within the charge electrode 71 and the second at the output of the charge control electrode 72. Diode 86 allows the quality of the drop formation to be checked visibly and diode 87 allows the speed of these drops to be measured visually.

This electrode support block 70 also supports the left deflection plates 73 and 74 which are fixed for example by means of screws 58. However, according to an important characteristic of the invention, taking into account the geometry of this support block 70 and its structure, deflection electrodes may be deposited on the internal wall of this support in the form of a layer of conducting material which then plays the role of the above described deflection plate 73 and 74. According to the invention, one of the deflection plates (73) or layer is brought to a high potential (of the order of 800 volts for example) whereas the second deflection plate 74 (or layer) is kept at zero potential.

As was mentioned above, considering the electrical requirements, the insulation between the support blocks 70 and the monolithic base 2, as well as between this block 70 and the charge electrode 71 must be efficiently provided. To fulfill this function, on the one hand, the thickness of the support block 70 itself made from an insulating material is optimized and, on the other hand, an insulating groove 89 and a wall 90 are provided for this purpose.

An adjustment means 57 sliding laterally on two pins 810 ensures the translational positioning ($\tau$) of the support block 70 and allows the two deflection plates or layers to be perfectly positioned with respect to the jet of drops.

Figure 4:
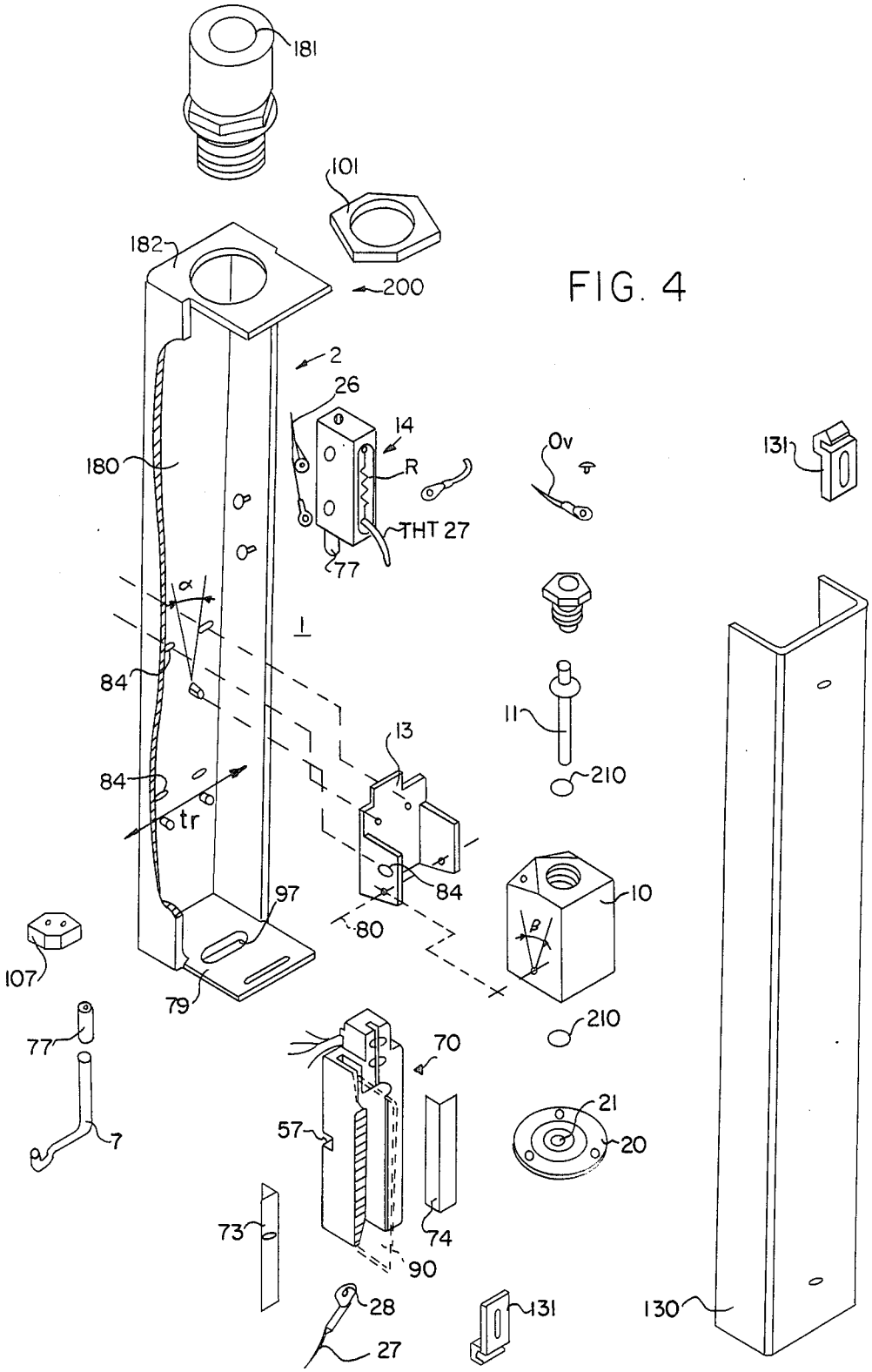
FIG. 4 is an exploded view of the components forming a printing head in accordance with the invention.

FIG. 4, which is an exploded view of a printing head in accordance with the invention, recapitulates the assembly of components forming it and allows mounting thereof to be visualized.

We find again then the monolithic piece 2 whose wall 180 serves as base for the assembly of the elements forming head 1. A connection 181 and its nut 101 fix the external ink circuit to the upper bottom 182. On this wall 180, a box (cavity) not shown is provided for enclosing and shielding the signal amplifier 40. At this level is also housed the ink recovery detector 14.

According to an important characteristic of the invention, as has already been mentioned, this detector 14 is made from an insulating material and comprises a resistor R integrated in this insulator. This resistance is mounted in series in the circuit THT of the deflection plate 73 brought to the potential of 8000 volts so that in the case of breakdown of this latter, this resistor R plays the role of current limiter.

The coaxial cable 26 like the circuit THT 27 are connected conventionally by means of tags 28.

According to an important characteristic of the invention, as has already been mentioned and which is particularly illustrated in FIG. 4, the modulation body 10 with the nozzle carrying base 20 is orientatable through two angles ($\alpha$) and ($\beta$); thus the ink jet may be perfectly centered by adjusting these two degrees of freedom.

In this FIG. 4 are also clearly shown the charging and charge control electrodes, as well as the deflection electrodes (or layers) whose insulation is provided by means of the above described insulating groove and wall.

The lower bottom 70 of the monolithic base 2 has an orifice 97 through which transit the deflected drops before reaching the surface during marking (not shown in the Figure). The recovery gutter 7 is fixed by a flange 107. Finally, a lid 130 is fixed to the monolithic base 2 by means of clips 131 thus forming an external cover protecting the printing head 1. Such a printing head is compact, easy to adjust and finds its application in ink jet printers with a single nozzle head.

We claim:

1. A single nozzle ink jet printing head (1) of the type including a supply circuit (100), means for breaking up the jet and ejecting the drops, means for charging and deflecting these latter; characterized in that a signal amplifier (40), a modulation body (10) orientable through two angles ($\alpha$) and ($\beta$) in two perpendicular planes, a support block (70) in which are integrated the charge (71) and charge control (72) electrodes and the deflection electrodes (73) and (74) are mounted in a monolithic piece (2), this latter serving both for shielding the amplifier (40) and for supporting the modulation body (10) and the support block (70).

2. Printing head according to claim 1, characterized in that means for adjustment along (tr) allow the support block (70) supporting the charge and drop deflection electrodes to be positioned, by translation along (tr), in the axis of the jet.

3. Printing head according to claim 1, characterized in that a groove (89) and a web (90) provide the insulation of the charged deflection plate (73).

4. Printing head according to claim 1, characterized in that two light emitting diodes (86) and (87) are integrated in the support block (70), the first at the level of the charge electrode (71) for visually checking the formation of the drops, the other at the level of the charge control electrode (72) for visually checking the speed of these drops.

5. Printing head according to claim 1, characterized in that two electrodes (73) and (74) are formed by two metal layers deposited on the internal wall of the support block (70).

6. Printing head according to claim 1, characterized in that one of the deflection electrodes (73) is brought to a very high potential, the second electrode (74) being kept at zero potential.

7. Printing head according to claim 1, characterized in that it includes a charge control electrode integrated in a block supporting the charge electrode (71) and the deflection plates (73) and (74).

8. Printing head according to claim 1, characterized in that an ink detector placed in the ink recovery circuit (77) connected to the gutter (7) has a resistor (R) mounted in series in the circuit placing the deflection electrodes (73) and (74) under tension.

* * * * *